United States Patent [19]

Imaeda et al.

[11] Patent Number: 4,695,033

[45] Date of Patent: Sep. 22, 1987

[54] MODULAR PANEL FOR MOLD

[75] Inventors: Fumihiro Imaeda; Yoshio Imaeda, both of Nagoya, Japan

[73] Assignee: Shin Nihon Kohan Co., Ltd., Komaki, Japan

[21] Appl. No.: 814,197

[22] Filed: Dec. 27, 1985

[30] Foreign Application Priority Data

Oct. 19, 1985 [JP] Japan ..... 60-160651[U]
Oct. 19, 1985 [JP] Japan ..... 60-160650[U]

[51] Int. Cl.[4] ..... E04G 9/10; E04G 11/46

[52] U.S. Cl. ..... 249/189; 52/537; 52/672; 52/674; 249/112; 249/113; 249/192; 428/603

[58] Field of Search ..... 249/189, 28, 20, 31, 249/32, 35, 112, 113, 192, 188; 264/33, 34; 52/795, 796, 537, 582, 720, 726, 630, 674, 801, 671, 672; 428/603, 596

[56] References Cited

U.S. PATENT DOCUMENTS

| | | | |
|---|---|---|---|
| 849,427 | 4/1907 | Rude | 52/674 |
| 1,029,864 | 6/1912 | Goldsmith | 52/674 |
| 1,670,243 | 5/1928 | Danis | 249/32 |
| 2,775,019 | 12/1956 | Bemis | 249/31 |
| 3,458,168 | 7/1969 | White | 249/189 |
| 3,664,630 | 5/1972 | Maynen et al. | 249/189 |
| 4,068,366 | 1/1978 | Hillesheim | 428/596 |
| 4,251,970 | 2/1981 | Home | 52/674 |

FOREIGN PATENT DOCUMENTS

| | | | |
|---|---|---|---|
| 1032117 | 6/1966 | United Kingdom | 52/674 |

OTHER PUBLICATIONS

Improved Concrete Form, "Plastics World", Jan. 1955.

*Primary Examiner*—Willard E. Hoag
*Assistant Examiner*—James C. Housel
*Attorney, Agent, or Firm*—Lahive & Cockfield

[57] ABSTRACT

A modular panel which may be combined with others to constitute a mold for depositing concrete or the like is disclosed. Each modular panel is corrugated to have ridges and troughs which extend parallel to and alternating with each other. At least the troughs are provided with openings in the form of elongate slots with or without circular holes combined therewith such that the openings define nailing passages in alignment with those of another modular panel which is joined with that panel, with no regard to the relative position of the joined panels. An elastic transparent strip is adhered to the bottom of each trough to cover the openings while allowing nails to be driven therethrough.

11 Claims, 19 Drawing Figures

MODULAR PANEL FOR MOLD

BACKGROUND OF THE INVENTION

The present invention relates to a modular panel for constructing a mold and, more particularly, to a modular panel which may be joined with others in a desired configuration to construct a mold for depositing concrete or the like.

In the art of civil engineering, for example, a mold for placing concrete has heretofore been implemented by relatively thick plywoods each being produced by stacking and bonding a plurality of veneers together. Specifically, such plywoods, or panels, are assembled at a cite to form a mold in a particular configuration and, after use, disassembled to be reused. The problem with the prior art panels of the kind described is that since the veneers easily to come off or rot when impregnated with water, the panels cannot withstand more than three to four times of repeated use at most. Moreover, reuse of those panels is impracticable unless various time- and labor-consuming manipulations such as unnailing, removing adhered concrete, plugging holes and painting are performed.

The prior art panels for the above application are easy to cut so that a mold having any desired shape and dimensions can be provided with ease. However, once cut to provide a particular mold configuration, the panels are not usable any longer unless machined again. This, coupled with the need for various awkward manipulations as previously stated, has discouraged the reuse of machined panels. Discarding such machined panels which are potentially reusable is wasteful. In addition, the discarded panels which are usually destroyed by incineration only is undesirable from the environmental pollution standpoint. Further, due to the disposal of such a substantial percentage of the panels, a great number of panels have to be constantly stocked inviting the need for a disproportionate space for storage. This, combined with sharp fluctuations in the prices of wood, makes the management extremely difficult.

SUMMARY OF THE INVENTION

It is therefore an object of the present invention to provide a modular panel for a mold which has durability great enough to withstand repeated use.

It is another object of the present invention to provide a costeffective modular panel which allows a mold to be constructed in a desired configuration without producing fragments.

It is another object of the present invention to provide a modular panel for a mold which promotes the ease of management.

It is another object of the present invention to provide a generally improved modular panel for a mold.

A modular panel for forming a mold of the present invention includes a plurality of parallel ridges and a plurality of parallel troughs which extend in a predetermined direction and alternate with each other. A plurality of openings are formed through a bottom of at least each of the troughs such that the openings when aligned with openings of another such modular panel define through passages for nails.

In accordance with the present invention, a modular panel which may be combined with others to constitute a mold for depositing concrete or the like is disclosed. Each modular panel is corrugated to have ridges and troughs which extend parallel to and alternating with each other. At least the troughs are provided with openings in the form of elongate slots with or without circular holes combined therewith, such that the openings define nailing passages in alignment with those of the other panels with no regard to the relative position of the joined panels. An elastic transparent strip is adhered to the bottom of each trough to cover the openings while allowing nails to be driven therethrough.

The above and other objects, features and advantages of the present invention will become more apparent from the following detailed description taken with the accompanying drawings.

DESCRIPTION OF THE PREFERRED EMBODIMENTS

While the modular panel for a mold of the present invention is susceptible of numerous physical embodiments, depending upon the environment and requirements of use, substantial numbers of the herein shown and described embodiments have been made, tested and used, and all have performed in an eminently satisfactory manner.

Figure 1:
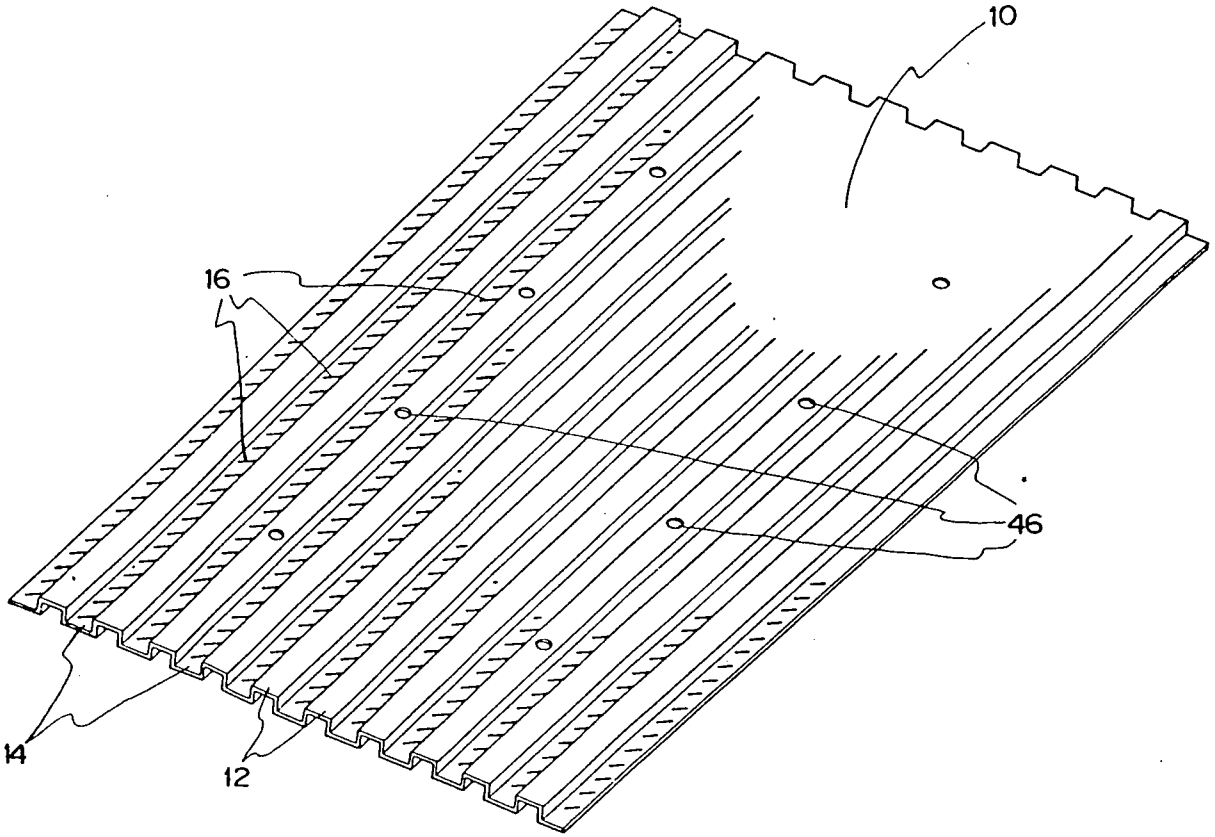
FIG. 1 is a perspective view of a modular panel embodying the present invention.

Referring to FIG. 1 of the drawings, a modular panel in accordance with the present invention is shown and generally designated by the reference numeral 10. The panel 10 is corrugated to have ridges 12 and troughs 14 which alternate each other at predetermined pitches. In this particular embodiment, the panel 10 comprises a keystone plate which is substantially 180 centimeters long, 90 centimeters wide, and 1 millimeter thick. Having an inverted trapezoidal cross-section, each of the troughs 14 is substantially 40 millimeters wide at the bottom, 50 millimeters wide at the open top, and 12 millimeters high. The ridges 12 adjacent to the troughs 14 are complementary in configuration to the latter.

Slots 16 are formed through the bottom of each trough 14 at equally spaced locations along the length of the trough 14. The slots 16 are each inclined substantially 45 degrees to a line which is parallel to the trough 14. In the illustrative embodiment, the slots 16 are distributed throughout the bottom of each trough 14 each with a width of substantially 2.5 millimeters and a length of 40 millimeters. The reference numeral 46 designates perforations which are usable for a specific purpose as will be described.

Figure 2:
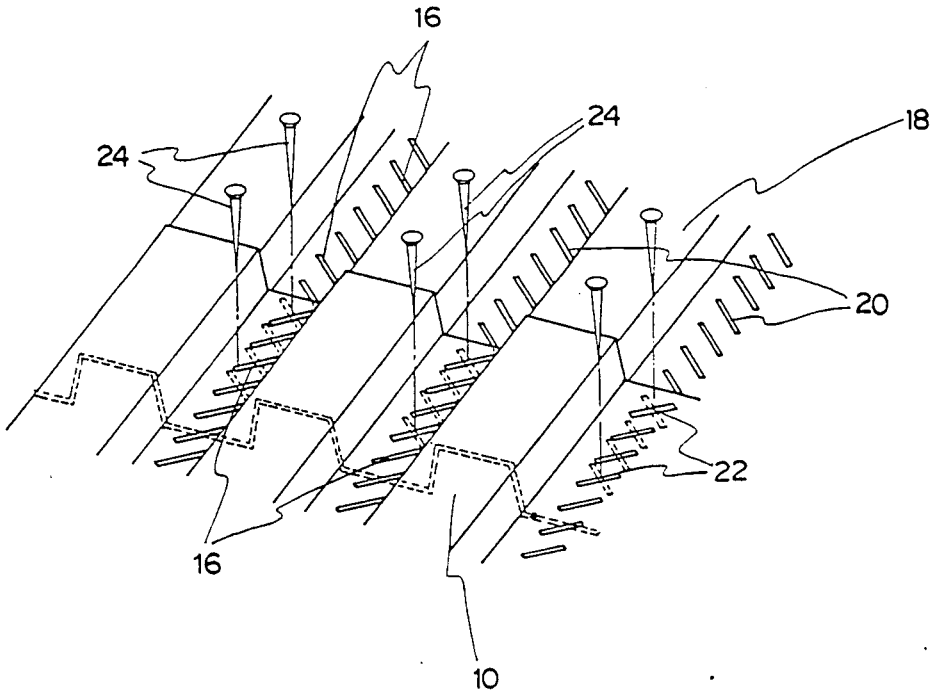
FIG. 2 is a fragmentary enlarged perspective view showing the panel of FIG. 1 which is joined with another such modular panel.

As shown in FIG. 2, the corrugated modular panel 10 having the above structure may be combined with another modular panel 18 having slots 20 which are inclined in the opposite direction to the slots 16. With the ridges 12 and troughs 14 overlapping each other, the joined panels 10 and 20 are slidable on and along each other so that their total dimension in a direction parallel to the ridges 12 and troughs 14 is adjustable steplessly. In addition, the total dimension of the panels 10 and 20 in a direction perpendicular to the ridges 12 and troughs 14 is adjustable by each pitch of the latter. This allows the panels 10 and 20 to be combined in a desired configuration such as a one having a removed portion or a one having total dimensions other than those of the modular panel 10 (or 20). The slots 16 and 20 in the overlapping portions of the panels 10 and 18 intersect each other due to their opposite directions of inclination so that even if the plates 10 and 20 are slid on each other, through passages 22 are necessarily defined somewhere in the overlapping region. Woodworking nails 24 may be passed through the passages 22 as will be described.

While the slots 16 have been shown and described as being formed only in the troughs 14 of the panel 10, they may also be provided in the ridges 12 to make the panel 10 usable in an inverted position. This eliminates the need for two different kinds of panels which are formed with slots with opposite directions of inclination as described.

Figure 3:
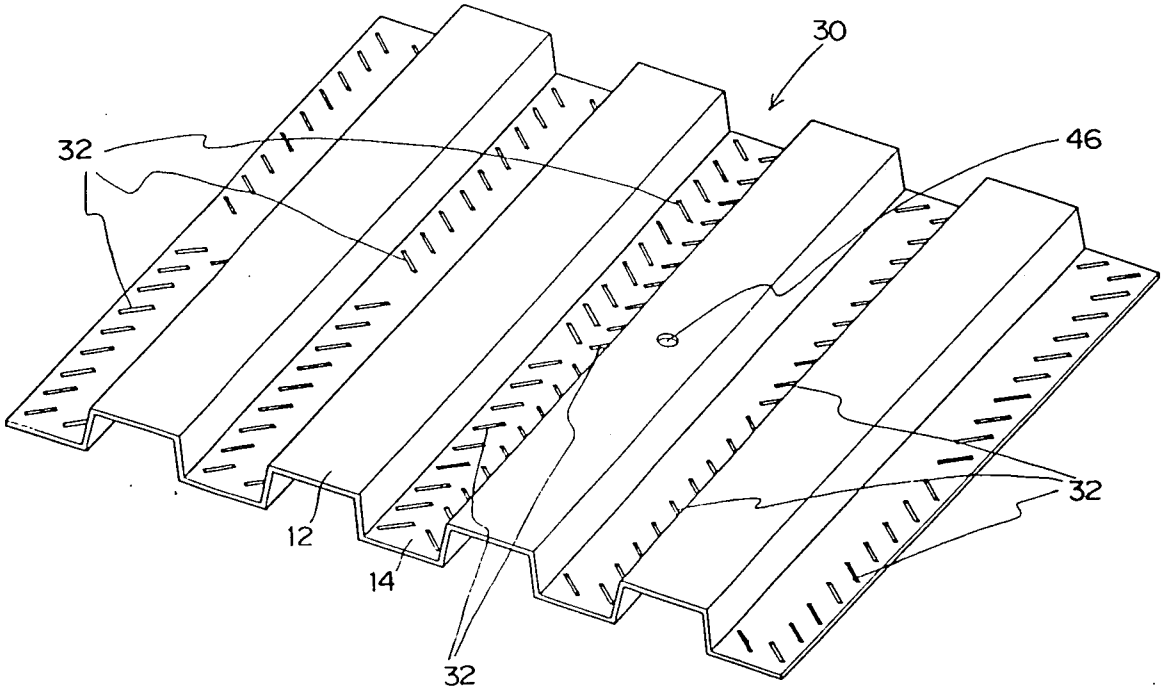
FIG. 3 is a perspective view of a modification to the panel of FIGS. 1 and 2.

Referring to FIG. 3, a modified form of the modular panel 10 of FIG. 1 is shown. In FIG. 3, the same or similar structural parts as those shown in FIG. 1 are designated by like reference numerals. The modified panel, generally 30, is essentially similar to the panel 10 except for the configuration of the slots. Specifically, in FIG. 3, slots 32 are formed in two arrays through the bottom of each trough 14 such that they are inclined symmetrically with each other with respect to a lengthwise center line of the trough 14. The slots 32 are also inclined symmetrically with each other with respect to a widthwise center line of the trough 14.

Figure 4:
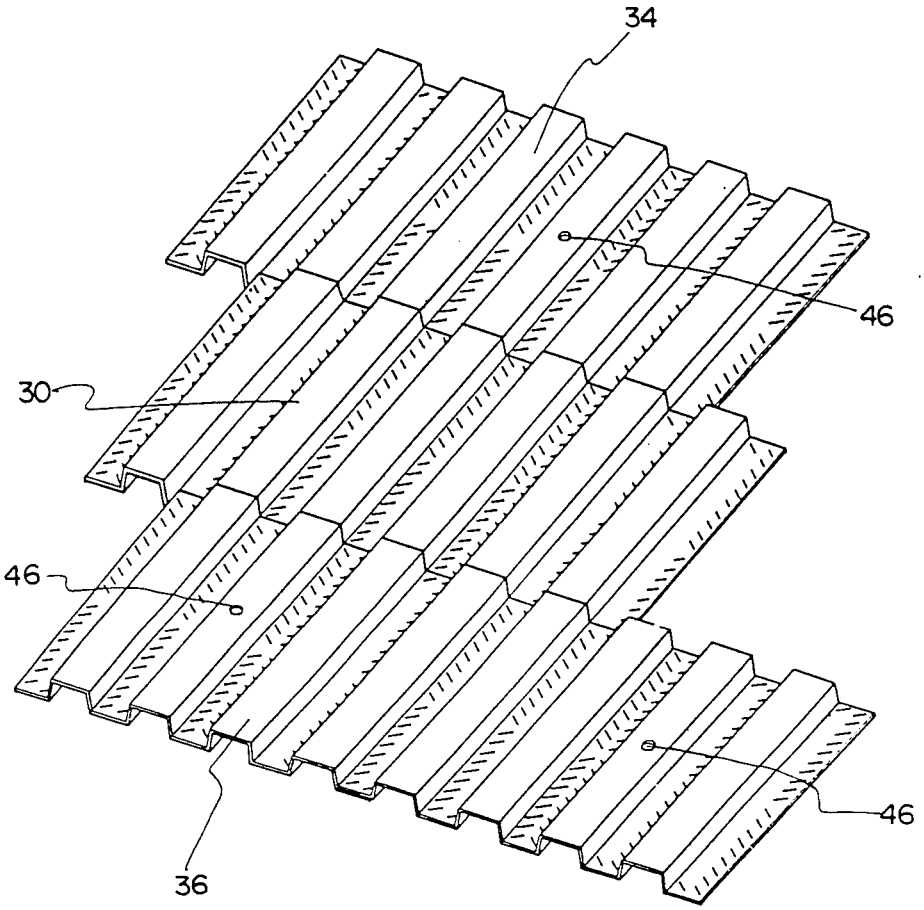
FIG. 4 is a perspective view showing the panel of FIG. 3 which is combined with other such panels.
Figure 5:
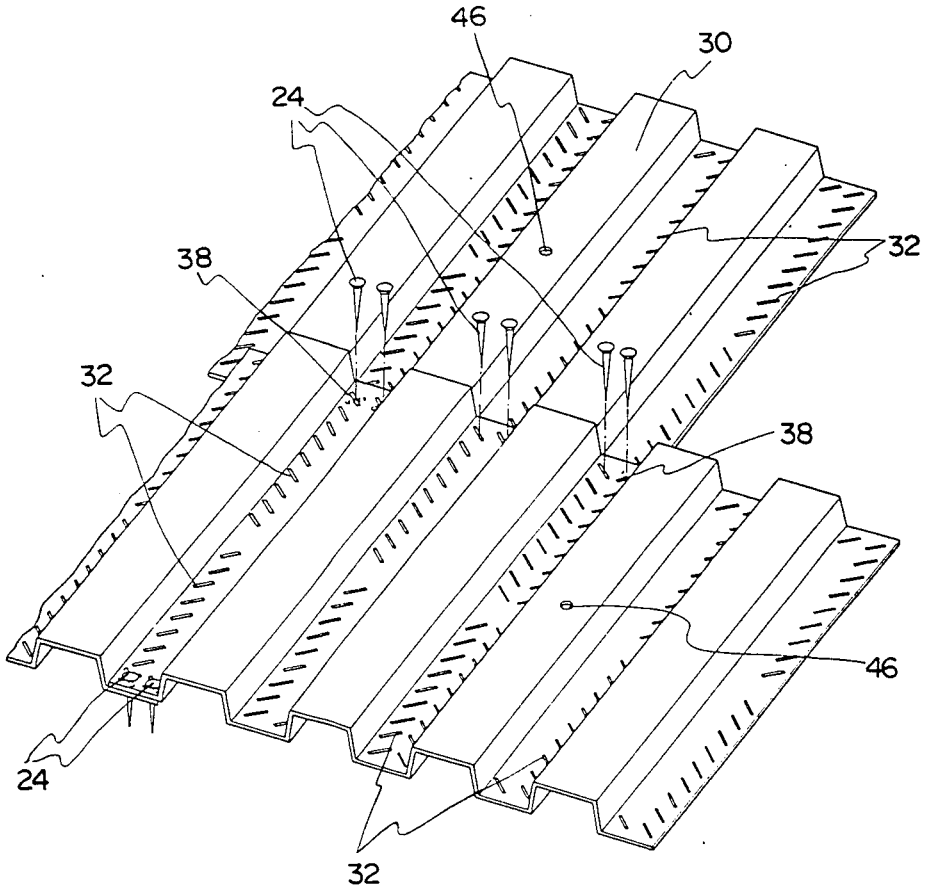
FIG. 5 is a fragmentary enlarged perspective view of the panels which are joined as shown in FIG. 4.

As shown in FIG. 4, the modular panel 30 may be combined with another or other such panels, panels 34 and 36 in this particular example. In the illustrated overlapping condition, the panels 30, 34 and 36 are slidable along the ridges 12 and troughs 14 to any desired position without causing deviation in the pitches of the ridges 12 and troughs 14. In the direction perpendicular to the ridges 12 and troughs 14, a plurality of such panels can be efficiently joined together overlapping their ends. Therefore, the panel 30 eliminates the need for provision of panels having different configurations. As shown in Fig. 5, the slots 32 of adjacent panels intersect each other to define through passages 38 in each of the array in the trough 14. As previously stated, woodworking nails 24 may be passed through the passages 38.

Figure 6:
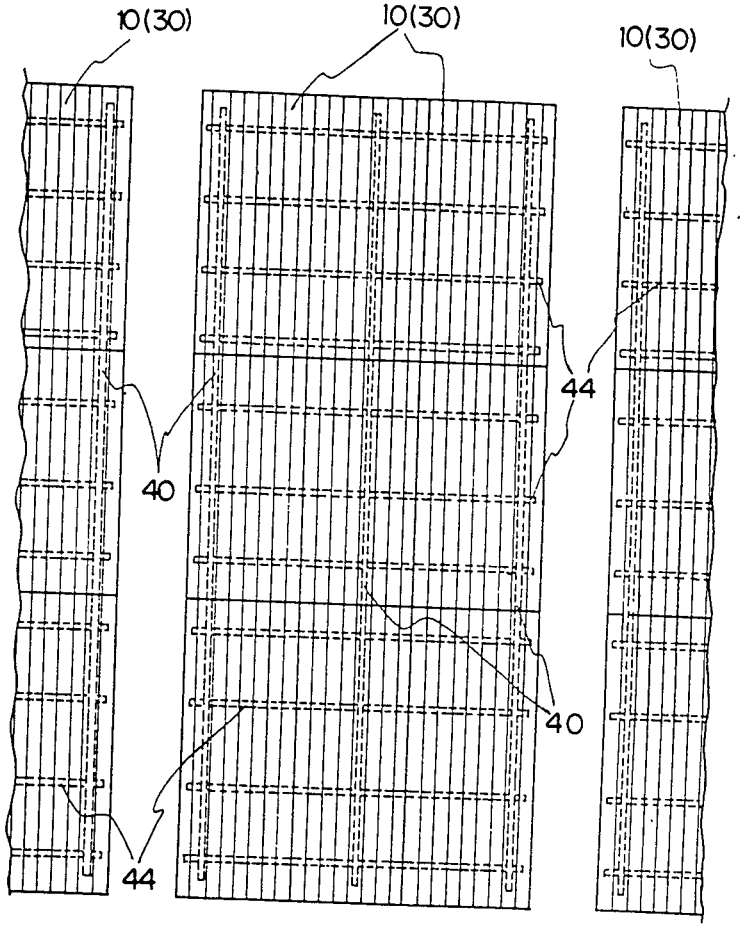
FIG. 6 is a plan view showing an exemplary application of the panels each having the structure of FIG. 1 or its modification of FIG. 3 to a floor mold.
Figure 7:
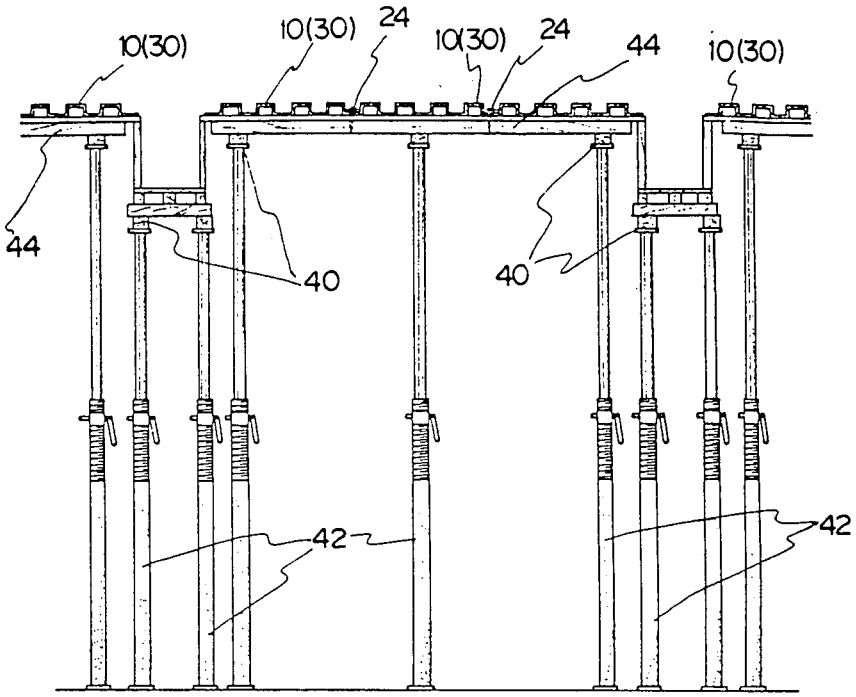
FIG. 7 is a side elevation showing the panels of FIG. 6 which are arranged on a substructure.

Referring to FIGS. 6 and 7, an exemplary application of any of the panels 10 and 30 shown and described to a mold adapted for a floor is shown. First, a substructure is set up by laying sleepers 40 on telescopic posts, or supports, 42 and then mounting joists 44 on the sleepers 40. The panels, such as the panels 10, are laid on the substructure and then nails 24 are driven into the joists 44 through the passages 22 to complete a mold. The procedure described so far is essentially similar to a traditional one which uses the prior art panels and, therefore, details thereof will not be described.

Where the plates 10 (or 30) are used to constitute side walls of a mold, they will be fixed in place by means of fasteners as is the case with the prior art panels. In this respect, it is preferable that each plate 10 be formed with the perforations 46 to allow the fasteners to be inserted therein. In the specific application of the panels 10 to a floor mold as described above, the openings 46 may be used to insert those hanger members associated with a ceiling.

Even if the dimensions of the floor to which the panels 10 (or 30) are applied are not an integral multiple of the modular panel, it is substantially needless to cut the panels because the panels 10 can be overlapped in any desired total dimensions. Since the passages 22 (or 38) appear without fail in alignment with the joists 44 due to the intersecting slots 16 (or 32), the plates 10 (or 30) can be easily fixed in place by means of ordinary woodworking nails 24 and in a stable manner at the intersections of the slots. Clearances which are short of a pitch of the ridges 12 and troughs 14 of the modular panel may be covered using veneers or exclusive filler members.

The panels 10 and 30 shown and described are each made of metal, most preferably light-weight metal. However, the material of the panels 10 and 30 may be selected from plastics for a light-weight design, although plastics fail to solve the environmental pollution problem. If desired, a coating may be provided on the surfaces of the panels to facilitate separation of concrete at the time of disassembly. All of these are also true with all the other embodiments and their modifications which will be described.

Figure 8:
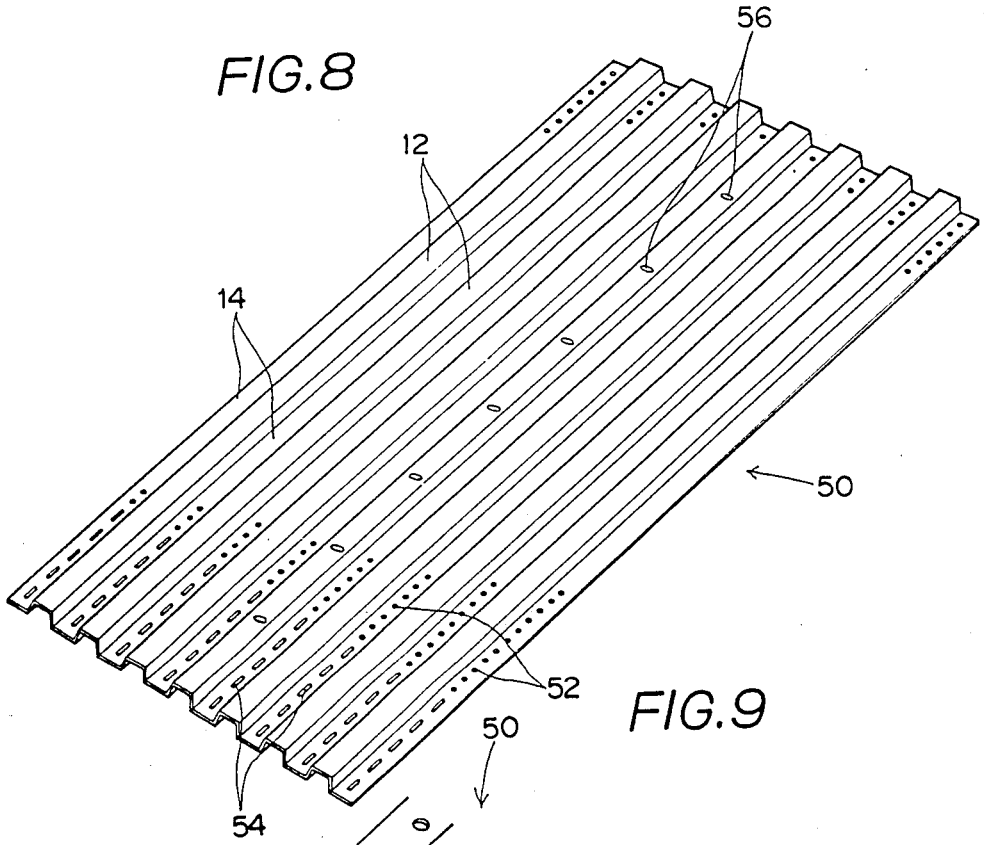
FIG. 8 is a perspective view of another embodiment of the present invention.

Referring to FIG. 8, another embodiment of the present invention is shown. In FIG. 8, the same or similar structural parts as those of FIG. 1 are designated by like reference numerals. A panel 50 shown in FIG. 8 is corrugated to have the ridges 12 and troughs 14 which alternate each other at predetermined pitched as previously described. In this particular embodiment, the panel 50 comprises a keystone plate which is substantially 1.2 millimeters thick. Having an inverted trapezoidal cross-section, each of the troughs 14 is substantially 35.2 millimeters wide at the bottom, 45.6 millimeters wide at the open top, and 12.8 millimeters high. The ridges 12 adjacent to the troughs 14 are complementary in configuration to the latter.

A plurality of circular holes 52 and a plurality of elongate slots 54 are formed in alignment through the bottom of each trough 14. The circular holes 52 and the elongate slots 54 in each trough 14 are individually located at equally spaced locations along the trough 14. In the illustrative embodiment, the distance between adjacent holes 52 is 12.5 millimeters. The slots 54 are each formed by communicating adjacent two of the holes 52 to each other. The slots 54 are confined in a limited strip region one side of which is deliminated by one of opposite ends of the panel 50 in the lengthwise direction of the ridges 12 and troughs 14. One of the ridges 12 which is located at the center is formed with perforations 56 at a predetermined spacing. The perforations 56, like perforations 46, are usable to insert fasteners in the case where the panel 50 is applied to a side wall mold, although they are not essential. In this particular embodiment, the distance between the adjacent perforations 56 is substantially 22.5 millimeters.

Figure 9:
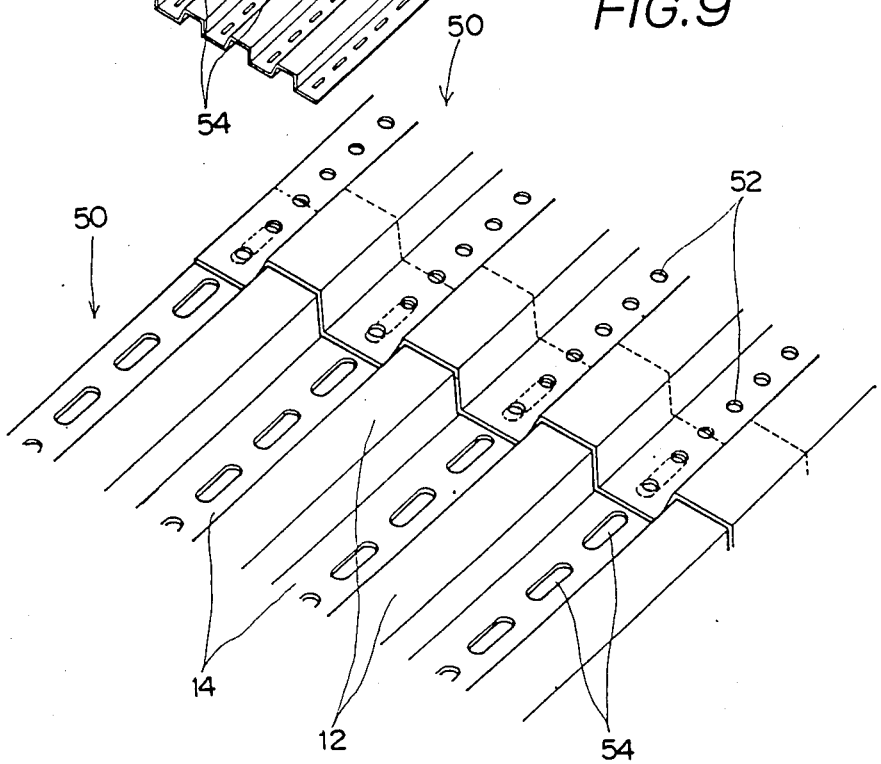
FIG. 9 is a fragmentary enlarged perspective view showing the modular panel of FIG. 8 which is joined with another such panel.

As shown in FIG. 9, a plurality of such panels 50 may be combined together with their ridges 12 and troughs 14 individually aligned with each other. In this position, the panels 50 are slidable on and along each other so that their total extension is adjustable steplessly in parallel with the ridges 12 and troughs 14. In addition, the total dimension of the panels 50 is adjustable in a direction perpendicular to the ridges 12 and troughs 14 by each pitch of the latter. In the overlapping portions of the panels 50, the elongate slots 54 of one panel and the circlar holes 52 of the other plate are aligned to provide passages through which nails may be passed, as will be described.

Figure 10:
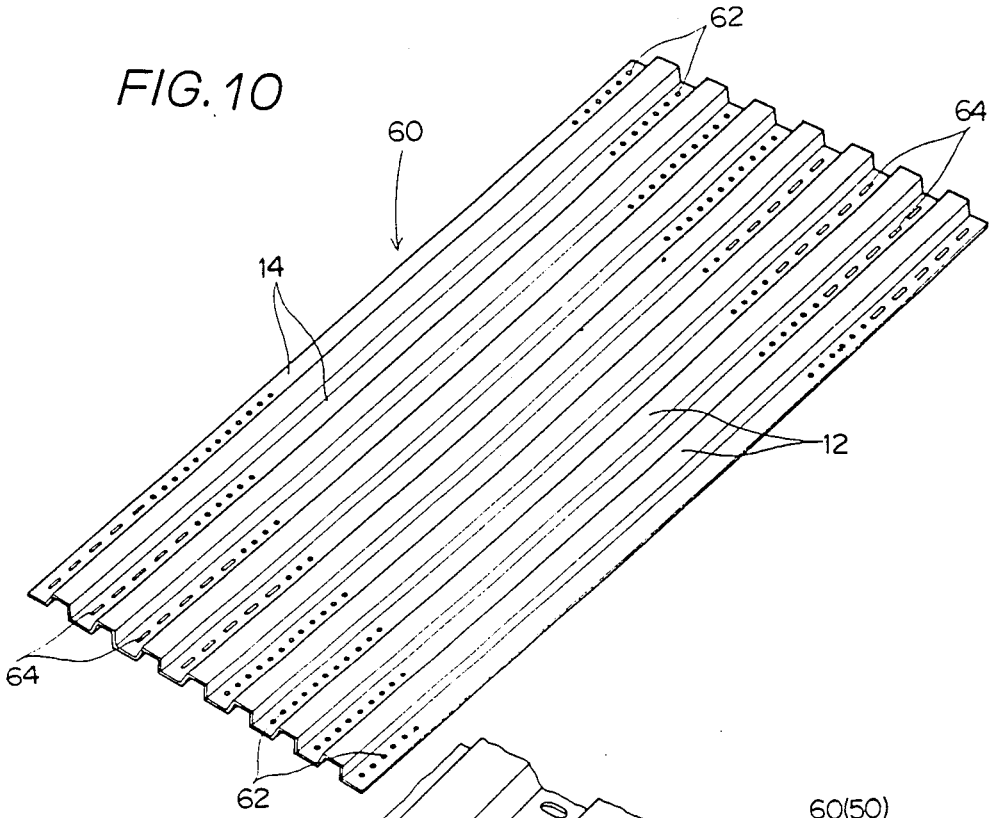
FIG. 10 is a perspective view showing a modification to the panel of FIG. 8.

Referring to FIG. 10, a modification to the panel 50 is shown and generally designated by the reference numeral 60. In FIG. 10, the same or similar structural parts as those shown in FIG. 8 are designated by like reference numerals. As shown, the panel 60 is provided with circular holes 62 and elongate slots 64 along each of the troughs 14. In this particular embodiment, the slots 64 are located in two particular regions of the panel 60 which are symmetrical with respect to the center of the panel 60.

The positions of the slots 54 and 64 shown in FIGS. 8 and 10 are not restrictive and may be replaced by a one in which the slots are distributed in a suitable ratio such as 3 : 1 in the opposite end portions of the panel. The gist is that elongate slots are combined with circular holes to insure nailing and fixing at the same time. That is, modular panels each having circular holes only might fail to define passages for nails therethrough when joined together due to misalignment of the holes; modular panels each having simple elongate slots only might fail to be rigidly fixed in place due to the length of the slots.

Figure 11:
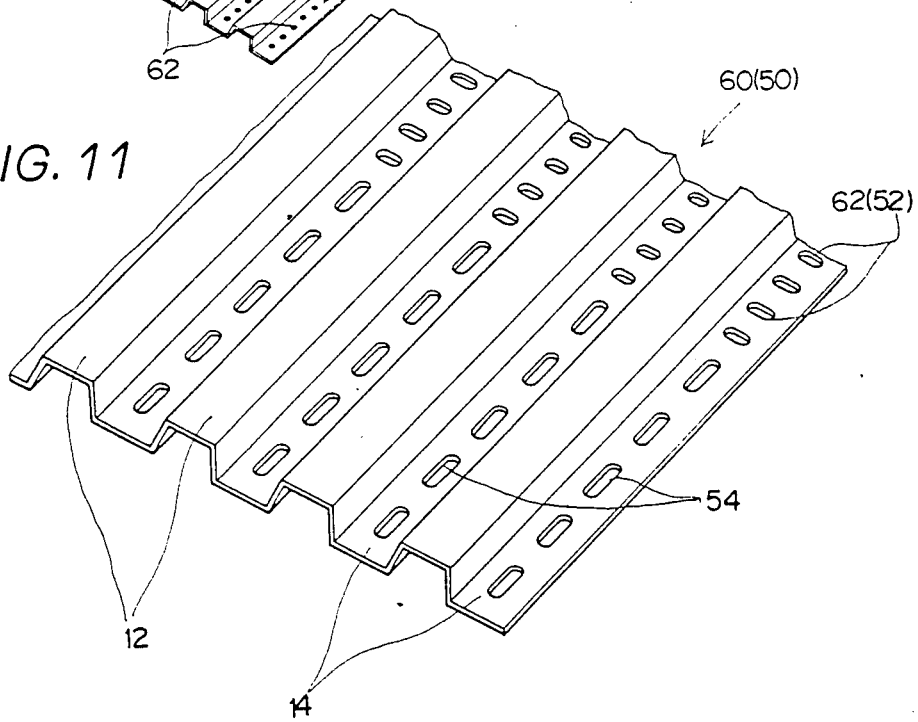
FIG. 11 is a fragmentary enlarged perspective view showing an alternative configuration of holes which is applicable to the panels shown in FIGS. 8 and 10.

As shown in FIG. 11, it is preferable that the circular holes 52 (or 62) each be dimensioned longer in the direction perpendicular to the ridges 12 and troughs 14 than in the direction parallel to the same. Such will successively cope with possible deviation of the holes from each other in the direction perpendicular to the ridges and troughs.

Figure 12:
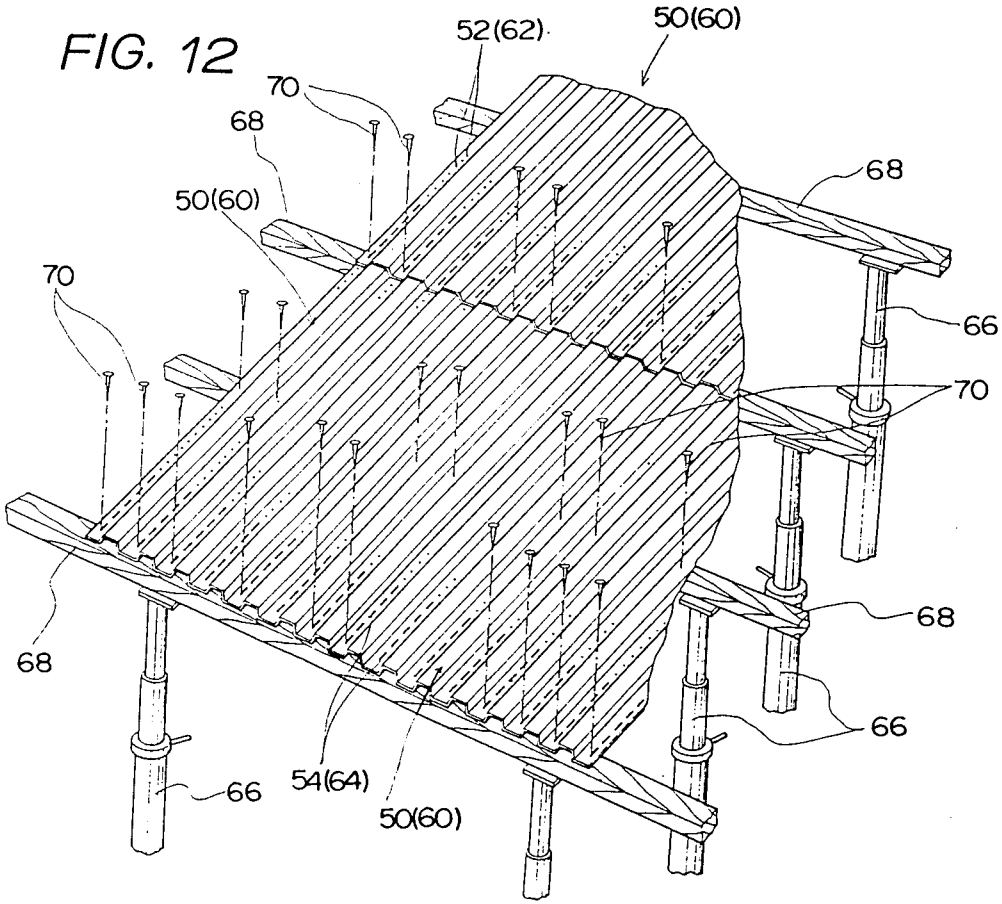
FIG. 12 is a partly taken away perspective view showing a specific manner of fixing the panels each having the structure of FIG. 8 or its modification of FIG. 10 in a practical application.

Referring to FIG. 12, a practical method of joining and fixing the panels 50 or 60 is shown in relation to a floor frame by way of example. Telescopic supports 66 are arranged at predetermined intervals to support sleepers 68 thereon. The panels 50, for example, are laid on the sleepers 68 overlapping each other at the end portions of the ridges 12 and troughs 14. In this condition, the circular holes 52 (or circular holes 62 and slots 64 of the plates 60) in those overlapping portions of the panels 50 are aligned with each other to form through passages. Then, woodworking nails 70 may be driven through the passages to fix the plates 50 in place. Again, clearances which are short of a pitch of the ridges 52 and troughs 54 may be filled up using veneers, exclusive filler members, etc.

Figure 13:
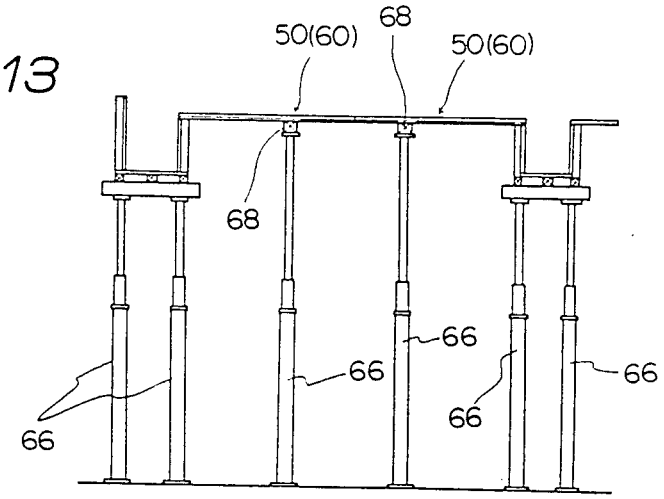
FIGS. 13 and 14 respectively are a sectional and a plan views showing a specific application of the panels shown in FIG. 8 or 10 to the construction of a concrete floor.
Figure 14:
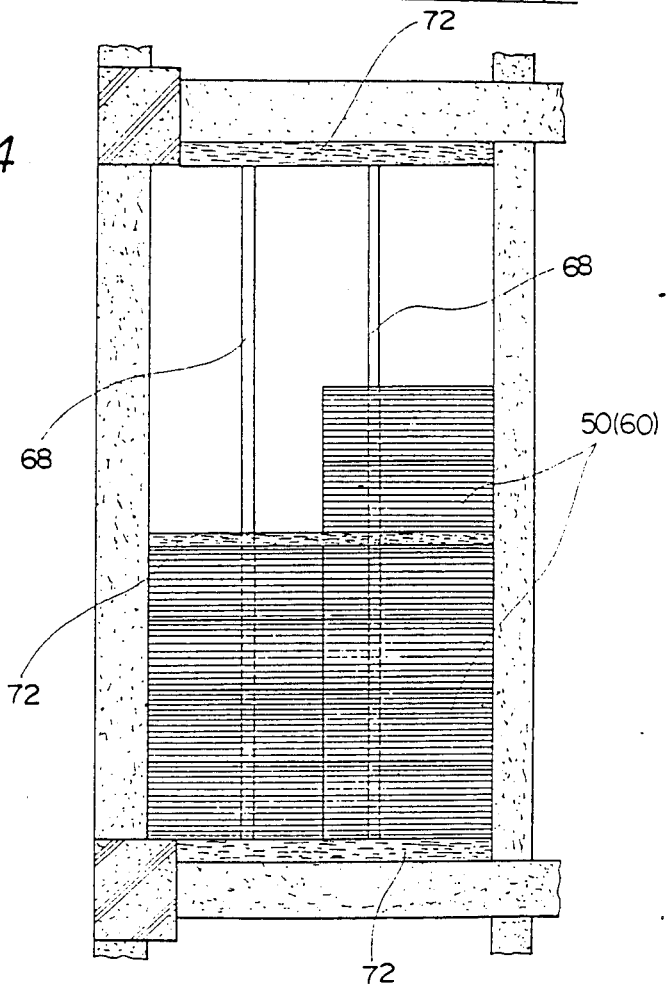

Referring to FIGS. 13 and 14, a substructure to which the panels 50 or 60 applied to provide a floor mold is shown. In FIGS. 13 and 14, the same or similar structural elements as those shown in FIG. 12 are designated by like reference numerals. The substructure consists of the telescopic supports 66 and the sleepers 68 which span the supports 66. The panels 50, for example, are directly laid on the sleepers 68 while partly overlapping each other. Clearances are filled up using veneers 72. To fix the panels 50 and the veneers 72 to the substructure, nails 70 may be directly driven into the sleepers 68 without using joists. This is permissible due to the substantial mechanical strength of the panels 50 and effective to save wood. Naturally, joists may be used in combination with the sleepers 68 as has been the case with the prior art method. During the construction of the mold, lighting is attainable through the circular holes and elongate slots of the panels 50 as in all the other embodiments, enhancing safety operations.

It will be seen from the above that the modular panel in accordance with any of the foregoing embodiments may be joined with others in a particular configuration which corresponds to a desired execution area, even if the execution area is not an integral multiple of the area of the modular panel. This eliminates the need for cutting plates. In overlapping portions of the joined panels, through passages are defined without fail by aligned slots or aligned slots and holes so that the panels can be fixed in place merely by driving woodworking nails through the passages. Hence, a mold can be completed with substantially the same or even simpler procedure than that performed with the prior art panels, e.g. constructing a substructure and then nailing the panels to the substructure. Where the panel is made of metal, it attains considerable durability to withstand a far greater frequency of repeated use than the prior art panels, making it needless to constantly stock a prohibitive number of panels. Also, the metallic panel allows a minimum of concrete to adhere thereto. The panel can be reused without requiring troublesome manipulations such as unnailing, plugging holes and cutting, partly because the nails are simply loosely received in the passages of the plates. Even when damaged, the panels can be collected as scraps to be reused. Furthermore, the panels may be transported and stored with their ridges and troughs individually aligned in order to reduce space requirement, whereby transport and storage on a quantity basis is promoted.

The panel in accordance with any of the foregoing embodiments is provided with nailing openings in the form of elongate slots with or without circular holes combined therewith. Although fulfilling the desired objective, the nailing openings should preferably be provided with an implementation for preventing water from leaking therethrough during, for example, a curing period of concrete. Leakage of water through the openings would make the ground near the mold muddy to affect the operation efficiency.

Figure 15:
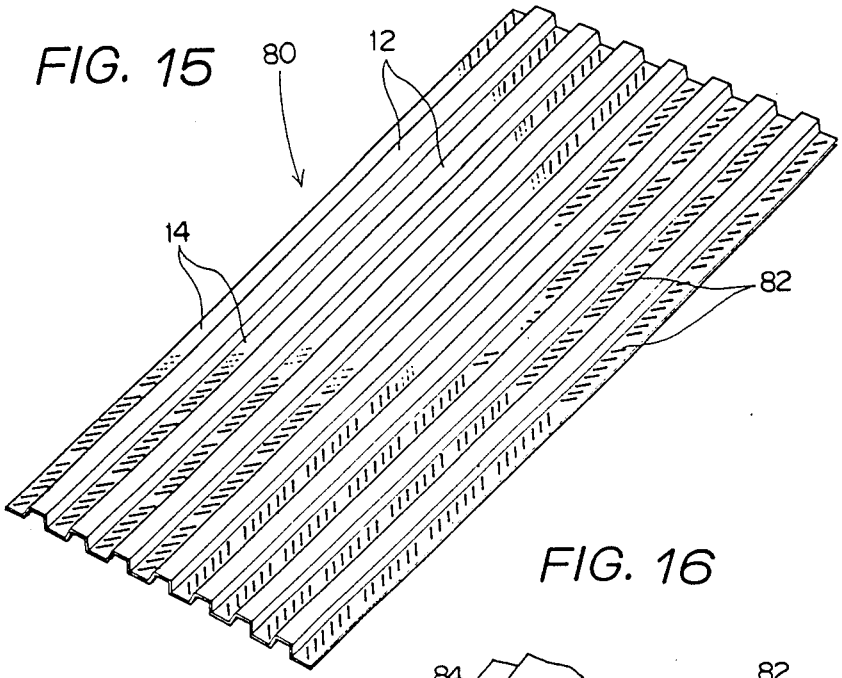
FIG. 15 is a perspective view of a farther embodiment of the present invention.
Figure 16:
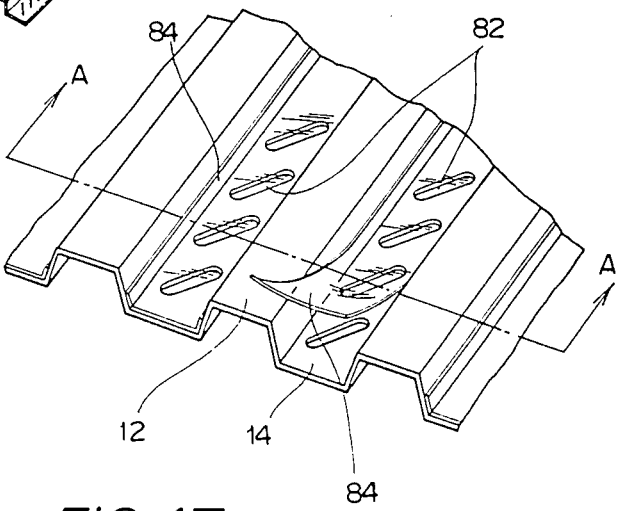
FIG. 16 is a fragmentary enlarged view of the modular panel of FIG. 15.
Figure 17:
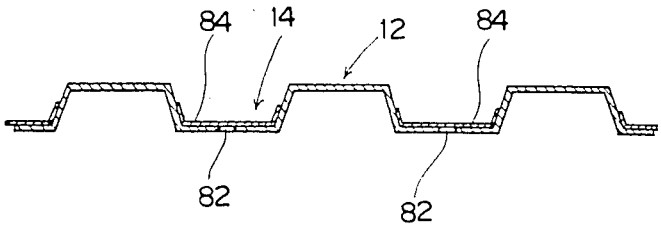
FIG. 17 is a section along line A—A of FIG. 16.

Referring to FIGS. 15, 16 and 17, a further embodiment of the present invention which is furnished with an implementation against leakage of water through the nailing openings is shown. In FIGS. 15–17, the same or similar structural elements as those shown in FIG. 1 are designated by like reference numerals. A panel 80 is corrugated to have the ridges 12 and troughs 14 which alternate with each other at predetermined pitches. In this particular embodiment, the panel 80 is implemented by a keystone plate which is substantially 180 centimeters long, 90 centimeters wide, and 1.2 millimeters thick by way of example.

Elongate slots 82 are formed through the bottoms of all the troughs 14. The slots 82 in each trough 14 are positioned in equally spaced locations along the trough 14 and each is inclined 45 degrees to a line which is parallel to the trough 14, while extending substantially radially with respect to the center of the panel 80. In this particular embodiment, each trough 14 has an inverted trapezoidal cross-section which is substantially 35.2 millimeters wide at the bottom, 45.6 millimeters wide at the open top, and 14 millimeters high, while each slot 82 is dimensioned substantially 3 millimeters wide and 21 millimeters long. A strip 84 made of a transparent plastic synthetic such as polypropylen is applied with acryl-based adhesive on one side thereof and bonded to the bottom of each trough 14 to cover the slots 82. In the illustrative embodiment, the transparent strip 84 is dimensioned substantially 40 millimeters wide. It should be noted that the materials of the strip 84 and adhesive mentioned above are not restrictive.

In this particular embodiment, too, a plurality of such panels 80 may be combined together and freely slid along the ridges 12 and troughs 14 on each other to set up a desired total dimension. In addition, their relative position is variable in a direction perpendicular to the ridges 12 and troughs 12 on a pitch-by-pitch basis. That is, the overall size of the combined panels 80 is freely adjustable. Whatever the overall configuration of the panels 80 may be, the slots 82 are necessarily aligned in an X configuration somewhere in the overlapping portions of the panels 80 to define nailing openings. In this condition, the panels 80 are usable in the same manner as the prior art panels.

While the slots 82 have been shown and described as extending substantially radially with respect to the center of the panel 80, such is only illustrative. For example, they may alternatively be oriented in the same direction as the slots 16 of FIG. 1, or provided in a limited part of the panel 80, or replaced with a combination of circular holes and elongate slots as those 62 and 64 of FIG. 10 insofar as they are capable of defining nailing openings in cooperation. It will be understood that the transparent strips 84 are applicable to any of the foregoing embodiments and their modifications as well.

Figure 18:
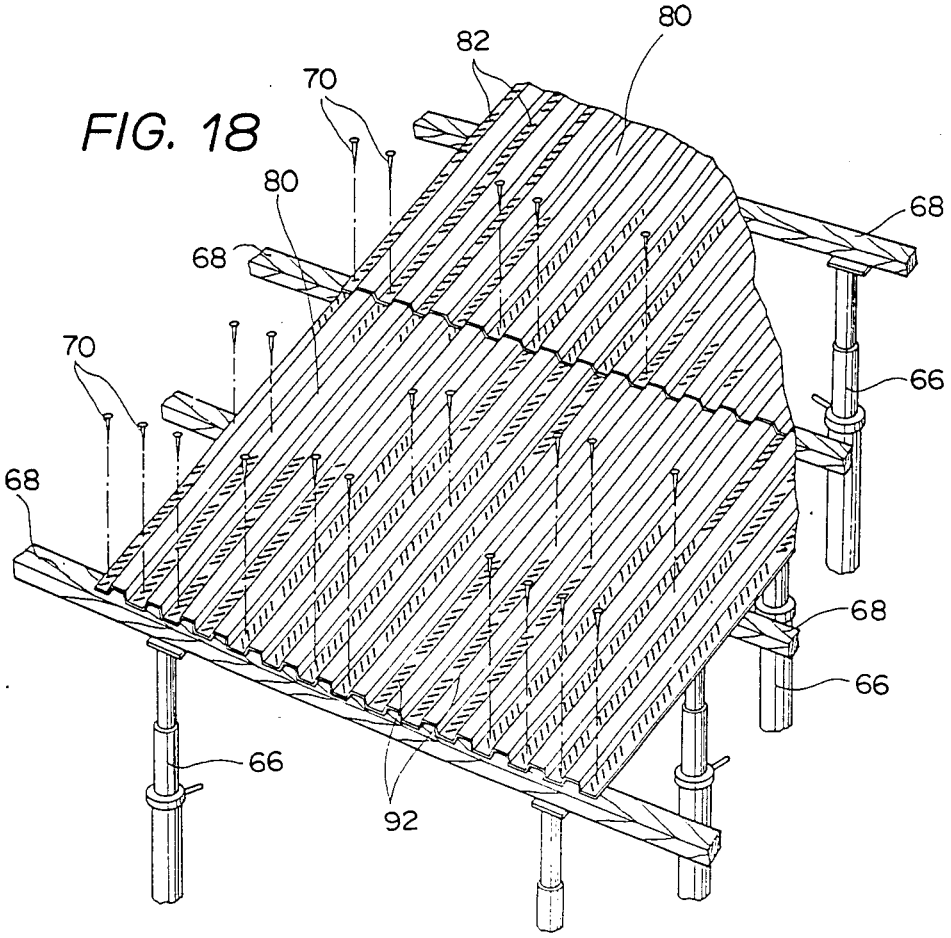
FIG. 18 is a perspective view showing a specific manner of fixing the panels each having the structure of FIGS. 15–17.
Figure 19:
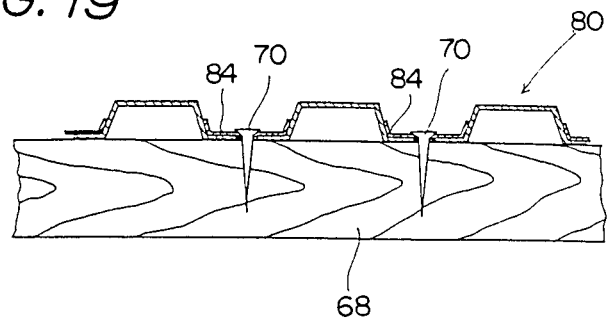
FIG. 19 is fragmentary enlarged section of the panel which is fixed in place by nails as shown in FIG. 18.

Referring to FIGS. 18 and 19, an exemplary application of the panel 80 to a floor mold is shown. Since the substructure shown in FIG. 18 is essentially similar to that of FIG. 12, the same structural elements of the former as those of the latter are designated by like reference numerals. The substructure comprises telescopic supports 66 and sleepers 68. A plurality of panels 80 are laid on the substructure with their edges overlapping each other. In the overlapping portions, the inclined slots 82 of the associated panels 80 intersect each other each in an "X" configuration, a through passage being defined at the center of "X". Nails 70 are driven into the sleepers 68 through the slots 82 located on the sleepers 68 and the through passages defined in the overlapping portions of the panels 80, thereby fixing the panels 80 to the sleepers 68. Again, clearances which are short of a pitch of the ridges 12 and troughs 14 may be filled up using, for example, veneers.

When concrete is deposited in the resulting mold, the transparent strips 84 serve to prevent water from leaking through the slots 82. Moreover, in the event of disassembling the mold, the nails 70 are easy to remove and, yet, the strips 84 are substantially restored to their original condition because the traces of penetration of the nails 70 are negligible due to the elasticity particular to plastics. The strips 84, therefore, will not bring about any problem at the time of reuse of the panels 80.

As described above, the panel 80 achieves an advantage that water contained in concrete is prevented from leaking through the slots 82 because the transparent elastic strip 84 adhered to the bottom of each trough 14 covers the slots 92, in addition to the various advantages which have been described in relation to the other embodiments.

In any of the foregoing embodiments, the corrugated plates which form a mold in combination will leave a complimentary shape on the surface of the molded concrete structure. The corrugation on the concrete surface may positively be used as a unique decorative pattern, or buried by facing, or covered with smoothly planed boards.

It is to be noted that in all the embodiments shown and described the specific configuration of the modular panel inclusive of the cross-sectional shape and dimensions is not restrictive and may be replaced with another insofar as it allows two or more modular panels plates to be joined along their edges.

Various modifications will become possible for those skilled in the art after receiving the teachings of the present disclosure without departing from the scope thereof.

What is claimed is:

1. A modular panel for forming a mold, comprising:

a plurality of parallel longitudinal ridges and a plurality of parallel longitudinal troughs which extend in a predetermined direction and alternate with each other, said ridges and troughs being connected by walls forming an angle other than an acute angle with said troughs; and a plurality of elongate openings formed through at least opposite end portions of a bottom of at least each of said troughs, not in parallel with the direction of the trough, but at an angle other than a right angle thereto, and in such a manner that said elongate openings, when aligned with openings of another modular panel define through passages for nails and enable said modular panels to mount substantially flush with one another, wherein said elongate openings are disposed in said trough in at least one array wherein those openings of said at least one array located above a transversal centerline of the panel are disposed at angles opposite to those openings located below said centerline.

2. Apparatus of claim 1, wherein said angle of said elongate openings to the direction of the trough is substantially 45 degrees.

3. A modular panel as claimed in claim 1, further comprising seal means for sealingly covering the openings while allowing nails to penetrate said seal means.

4. A modular panel as claimed in claim 3, wherein said seal means comprises an elastic transparent strip which is adhered to the bottom of each of the troughs to cover the openings.

5. A modular panel as claimed in claim 4, wherein said transparent strip is made of a plastic.

6. Apparatus of claim 1 wherein said elongate openings are disposed in said troughs in a single array wherein those openings located above a transversal centerline are disposed at angles opposite those openings located below said centerline.

7. Apparatus of claim 1 wherein said elongate openings are disposed in said troughs in two, adjacent arrays wherein those openings of both arrays located above a transversal centerline are disposed at angles opposite those openings of both arrays located below said centerline.

8. Apparatus of claim 1 wherein said elongate openings are disposed in said troughs in two, adjacent arrays wherein those openings located on either side of a longitudinal centerline of each trough are disposed at opposite angles, and wherein the openings of each array above a transversal centerline are disposed at angles opposite those openings of the corresponding array below said transversal centerline.

9. Apparatus of claim 1 wherein at least the two extreme troughs of a panel each have elongate openings which cover the entire length of said troughs.

10. Apparatus of claim 6 wherein said elongate openings positioned above said transversal centerline on one side of a longitudinal centerline are disposed at angles opposite said elongate openings disposed above said centerline and on the opposite side of said longitudinal centerline.

11. Apparatus of claim 10 wherein said elongate openings positioned below said transversal centerline and on one side of said longitudinal centerline are disposed at angles opposite said elongate openings disposed below said transversal centerline and on the opposite side of said longitudinal centerline.

* * * * *